US006638163B2

(12) United States Patent
Moody

(10) Patent No.: US 6,638,163 B2
(45) Date of Patent: Oct. 28, 2003

(54) STUD POKER GAMES

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 09/947,264

(22) Filed: Sep. 5, 2001

(65) Prior Publication Data

US 2003/0050107 A1 Mar. 13, 2003

(51) Int. Cl.[7] ..... A63F 9/24
(52) U.S. Cl. ..... 463/13; 463/16; 273/292
(58) Field of Search ..... 463/12–13, 16–20, 463/22, 25–28; 273/138.1, 139, 292, 274, 236

(56) References Cited

U.S. PATENT DOCUMENTS 5,100,137 A 3/1992 Fulton ..... 273/85 CP
5,167,413 A 12/1992 Fulton ..... 463/13
5,288,081 A 2/1994 Breeding ..... 273/292
5,417,430 A 5/1995 Breeding ..... 273/292
5,544,892 A 8/1996 Breeding ..... 273/292
5,732,950 A * 3/1998 Moody ..... 273/292
6,179,711 B1 * 1/2001 Yoseloff ..... 463/25
6,371,483 B1 * 4/2002 Edmunds et al. ..... 273/292

* cited by examiner

*Primary Examiner*—Kim Nguyen
(74) *Attorney, Agent, or Firm*—John Edward Roethel

(57) ABSTRACT

The player makes a wager and is dealt a five card poker hand. The player wins or loses depending on the poker hand ranking of the hand. If the player has achieved a winning poker hand combination, the player is paid according to the pay table and the player plays again for no additional wager. The player is dealt a new five card hand and the poker hand ranking of this new five card is determined. If the player has a losing hand, the game is over. If the player has a winning hand, the player is paid according to the pay table and the player receives yet another five card for no additional wager. This continues until the player receives a losing hand. The method of play can also be applied to multiple hands.

14 Claims, 5 Drawing Sheets

STUD POKER GAMES

This invention relates primarily to video poker games, and more particularly to electronic video stud poker games that are based on poker hand rankings and allow the player to continue to play winning hands without additional cost to the player. The player starts with a stud poker hand and as long as the player achieves a winning hand the player continues to play without having to make additional wagers.

BACKGROUND OF THE INVENTION

Five card, six card and seven card stud poker games have been played for many years, usually in a poker room setting in which a plurality of players play against each other striving to obtain the highest ranking poker hand (or lowest ranking poker hand in Lo-Ball poker) in order to win the pot which comprises the wagers made by the players during the play of the game.

Electronic video poker has also been a staple in gaming casinos for many years and this well known game is a single player game based on draw poker. The player attempts to achieve a winning poker hand ranking by discarding from an initial five card hand and drawing new cards in order to try and improve his poker hand. A pay table is provided to show the player what he can win based on the poker hand ranking achieved after the draw step and the amount wagered by the player.

There have been attempts to adapt stud poker to an electronic video game format. One attempt involved a single player seven card stud game in which the player makes a first wager and initially received three cards face up. In one version of this game, the player has the option of making additional wagers before the player receives the fourth, fifth, sixth and seventh cards. In another version, the player also has the option of making additional wagers before receiving the fourth, fifth, sixth and seventh cards unless the player has already achieved a winning poker hand combination, in which case the player is not allowed to make additional wagers. In either version, the final seven cards are analyzed and the best five card hand is used to determine the poker hand ranking of the player's hand. A pay table is used based on five card poker hand rankings and the amount wagered by the player to determine the amount won by the player when he achieves a winning hand.

Another popular single player stud poker game is known as DOUBLE DOWN STUD poker. This game is described in U.S. Pat. No. 5,100,137 and U.S. Pat. No. 5,167,413, the disclosures of each of which are incorporated herein by this reference. In DOUBLE DOWN STUD poker, the player makes a first wager and is dealt four cards all face up. The player may make an additional wager prior to receiving the fifth card. After the fifth card is dealt, the five card hand is compared to a pay table to determine if the player has a winning or losing card combination based on poker hand ranking.

Another stud poker game that has been adapted to a single player video poker format is a game known as LET IT RIDE®. In this game, the player makes a wager of three units at the start of each round of play. The player is then shown three cards face up. The player may decrease his wager by one unit or let all three wagers ride. The player is then shown a fourth card. The player may decrease his wager by one unit or let his wagers ride. The player is then shown a fifth card and the poker hand ranking of the final five card hand is used to determine winning or losing plays based on a pay table. The method of play of LET IT RIDE® is described in U.S. Pat. No. 5,288,081, U.S. Pat. No. 5,417,430 and U.S. Pat. No. 5,544,892, the disclosures of which are incorporated herein.

None of the previous attempts to put stud poker on an electronic video poker gaming machine rewarded the player with an additional free play of the game when the player achieved a winning play.

It is an object of the present invention to provide a stud poker game in which the player is awarded an additional play of a stud poker hand whenever the player receives a winning hand. This is in addition to also paying the player according to a pay table for his winning hand.

It is a feature of the present invention to deal and display a stud poker hand to the player. If the stud poker hand is winning hand, the player receives another play of the game for no additional wager and the player also receives a pay out for whatever winning hand combination he achieved.

It is another feature of the present invention to deal and display to the player multiple stud poker hands, which each stud poker hand being dealt from a separate deck of cards. For each winning hand achieved by the player, the player receives another play of that hand for no additional wager and the player also receives a pay out for whatever winning hand combination he achieved. The losing hands are not replayed.

It is an advantage of the present invention that the player may continue to receive additional plays of winning hands without additional wagers for as long as the player achieves winning hands. This makes the game very appealing to the player and can be quite rewarding to the player if he achieves a lucky streak and wins many hands in a row.

Other objects, features and advantages of the present invention will become apparent from a consideration of the following detailed description.

SUMMARY OF THE INVENTION

The method of the present invention involves the player making a wager to play a stud poker game. The player is dealt a single five card poker hand from a deck of playing cards. The player wins or loses depending on the poker hand ranking of the hand. The amount won by the player is based on the poker hand ranking of the hand and the amount wagered by the player according to a pay table.

If the player has achieved a winning poker hand combination, the player is paid according to the pay table and the player plays again for no additional wager. The player is dealt a new five card hand and the poker hand ranking of this new five card is determined. If the player has a losing hand, the game is over. If the player has a winning hand, the player is paid according to the pay table and the player receives yet another five card for no additional wager. This continues until the player receives a losing hand.

In a preferred embodiment of the present invention, the method of play is applied to multiple hands played at the same time. The player would make a wager which is allocated among the multiple hands. Each hand is dealt from a separate deck of cards. For each winning hand, the player is paid according to the pay table and the player also receives another play of that hand for no additional wager. This continues until the player has finally received a losing hand on all of the multiple hands that the player initially started with.

DETAILED DESCRIPTION OF THE PREFERRED EMBODIMENTS

The present invention is preferably an electronic video stud poker game and is designed to be played by having the stud poker hands displayed on a video screen. Alternatively, the present invention can also be played as a live table game with a dealer shuffling and dealing hands to one or more players seated around a gaming table.

Figure 1:
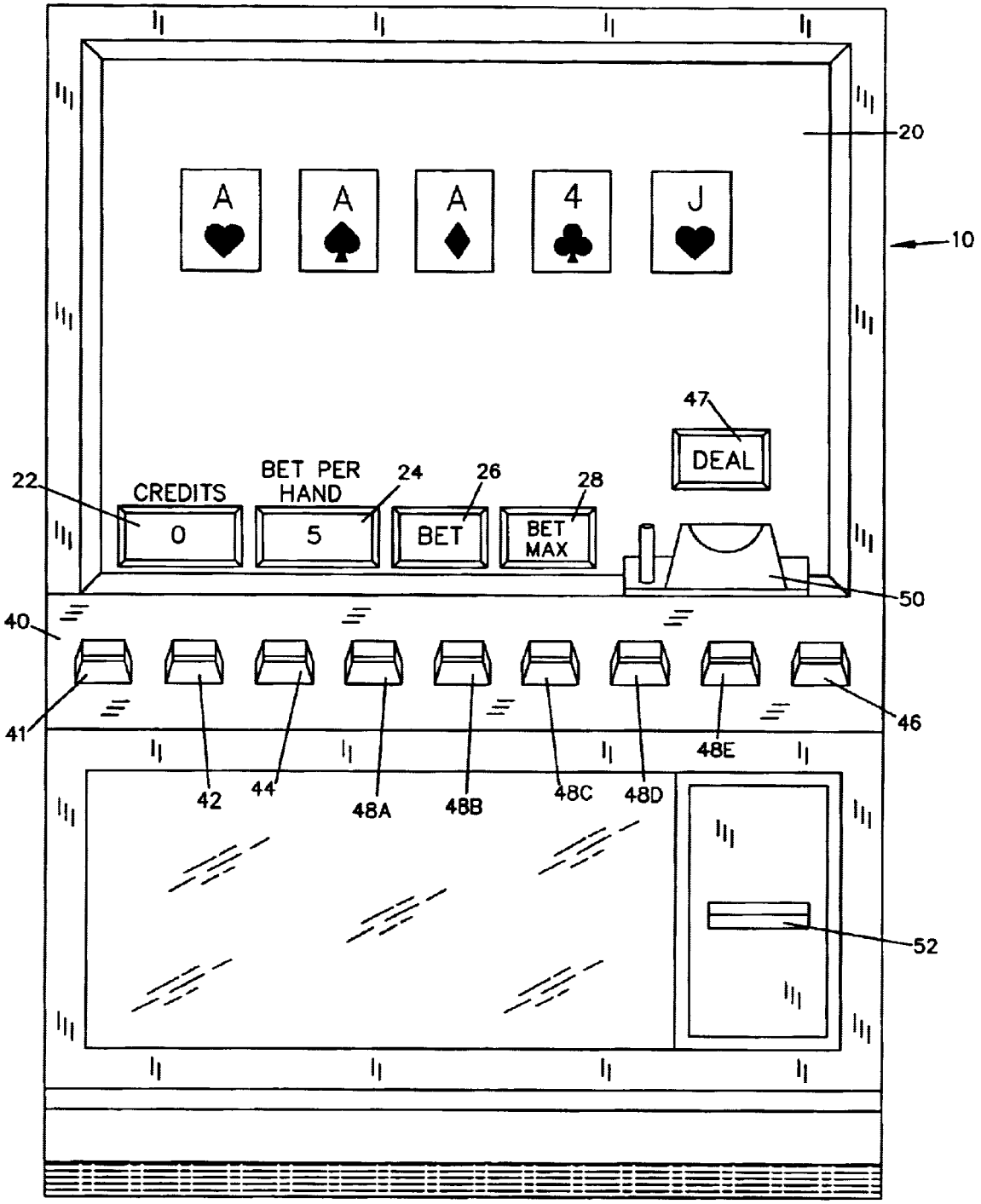
FIG. 1 shows a gaming machine configured to practice the method of present invention including a representative deal of a stud poker hand that could occur during the play of the game.

FIG. 1 shows a gaming machine upon which the method of the present invention can be carried out. The gaming machine includes a video screen display 20 on which is shown the playing cards that will be used during the play of the method of the present invention. The video screen display 20 also includes other information and data presented to the player to allow the player to understand the play of the game and to effect the operation of the method.

In the preferred embodiment of the present invention, the video screen display 20 shows a credit meter 22 and a display of the "bet per hand" 24 which is the number of credits wagered on each hand for a particular round of play of the game. The video screen display also has a DEAL touch screen location to allow the player to cause the initial deal of the cards to be displayed on the video screen display 20. Other touch screen locations allow the player to make his initial wager, which can be made one credit at a time using the BET ONE location 26 or which can be made by wagering the maximum number of credits allowed by the gaming machine using the BET MAX location 28.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits or to wager one credit at a time on the play of the game as desired by the player, if the player wishes to use buttons to place his wager instead of using the touch screen locations 26 and 28 to place his wager. A DEAL button 46 is provided to allow the player to effect the initial deal step of the method of play as desired should the player prefer to use the button panel instead of the DEAL screen location 47 on the video screen display 20.

The gaming machine 10 also includes a coin head 50 to allow the player to insert coins or gaming tokens as wagers to allow play of the gaming machine 10. A bill accepter slot 52 is also provided on the gaming machine 10. In order to accrue credits that may be used to play the gaming machine 10, the player inserts paper currency or other suitable script or gaming coupons into the bill accepter slot 52 behind which, on the interior of the gaming machine, is mounted a bill accepter which takes in and validates the currency. The monetary value of the inserted currency is then applied to the credit meter 22, the credits on which the player may use to play the gaming machine.

A plurality of buttons 48 can also be provided on the button panel 40 to allow the player to select the number of hands which the player wishes to play. For example, ONE HAND button 48A allows the player to select to play one hand of stud poker. THREE HAND button 48B allows the player to select to play three hands of stud poker. FIVE HAND button 48C allows the player to select to play five hands of stud poker. TEN HAND button 48D allows the player to select to play ten hands of stud poker. FIFTY HAND button 48E allows the player to select to play fifty hands of stud poker. Any suitable distribution of the number of hands can be allocated to the buttons and fewer or more than five buttons 48 can be used.

Instead of using buttons on the button panel, the video screen display 20 can be provided with touch screen locations (not shown) that the player would touch to select the number of hands that the player wishes to play.

Any other conventional and suitable equipment can be included in the gaming machine.

Version #1

Version #1 of the present invention in a preferred embodiment uses a standard fifty-two card deck of playing cards. A player makes a wager to activate the game and the player selects to play ONE HAND during that round of the game.

After the wager is made and after the deck of playing cards has been electronically shuffled, a first stud poker hand of five cards 60 is randomly dealt and displayed face up to the player on the screen display. FIG. 1 shows an example of such a deal in which the player is dealt the Ace of Hearts, the Ace of Spades, the Ace of Diamonds, the Four of Clubs and the Jack of Hearts.

The player has been dealt Three-of-a-Kind (three Aces) and, using a suitable pay table for this method of play, this would be a winning hand. The player is paid according to the pay table for a Three-of-a-Kind based on the amount of the player's wager. The player also is awarded another play of a five card stud hand without having to make an additional wager.

Figure 2:
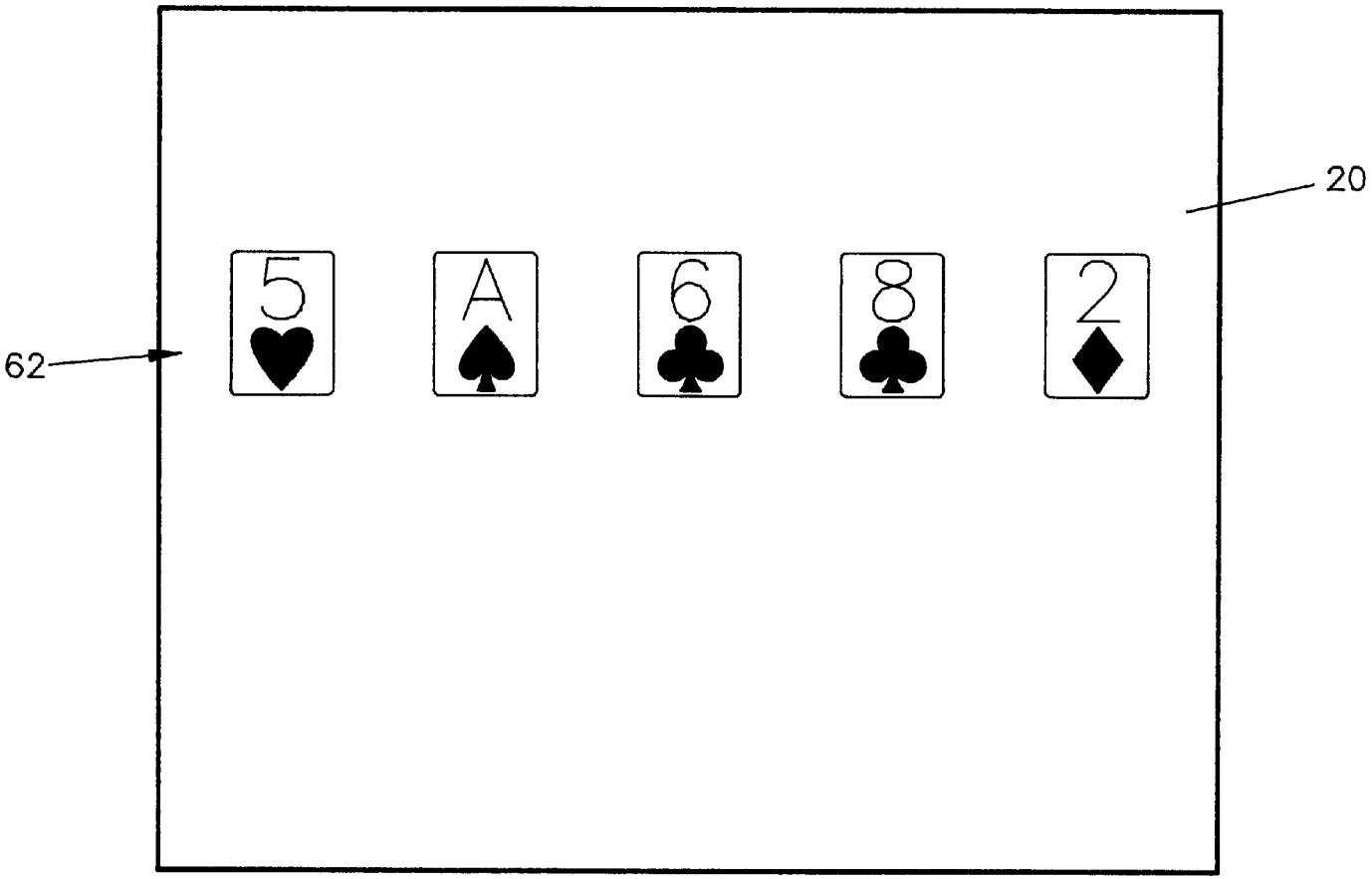
FIG. 2 show the screen display for a representative redial of a stud poker hand that could occur during the play of the game.

FIG. 2 shows an example of the additional play of the five card stud poker hand. Without having to make an additional wager, the deck of playing cards is electronically shuffled again and another stud poker hand of five cards 62 is randomly dealt and displayed face up to the player on the screen display. This second deal can be performed automatically by the computer controls of the gaming machine or the player can be required to press the DEAL button to effect this second deal. FIG. 2 shows an example of such a deal in which the player is dealt the Five of Hearts, the Ace of Spades, the Six of Clubs, the Eight of Clubs and the Two of Diamonds. Using a suitable pay table for this method of play, this would be a losing hand.

Because the player has achieved a losing hand on this deal, this round of the game is over. If the player wishes to continue playing, the player must make a wager and the method of play begins again as described above. The player will be awarded with additional plays of five card stud hands as long as the player achieves winning plays on his previous stud poker hand.

Any suitable poker hand combinations can be designated was winning and losing hand combinations. The amount won by the player is determined according to a pay table based on the poker hand combination achieved by the player and the amount wagered by the player.

Typically, pay tables are determined based on the mathematical probability of certain poker combinations occurring during the play of the game. Any suitable pay table can be used based on the percentage game return which the gaming establishment wishes to offer to the player. Any suitable pay table may be used and a representative pay table is shown in Table 1.

TABLE 1

| Poker Hand Combination | Payout Odds |
|---|---|
| Less than Pair of Sevens | Losing Hand |
| Pair of Sevens thru Aces | 1 for 1 |
| Two Pair | 3 for 1 |
| Three of a Kind | 5 for 1 |
| Straight | 7 for 1 |
| Flush | 9 for 1 |
| Full House | 18 for 1 |
| Four of a Kind (Fives through Kings) | 150 for 1 |
| Four of a Kind (Twos, Threes or Fours) | 250 for 1 |
| Four Aces | 400 for 1 |
| Four Twos, Threes or Fours with a Kicker | 500 for 1 |
| Four Aces with a Kicker | 800 for 1 |
| Straight Flush | 1000 for 1 |
| Royal Flush | 5000 for 1 |

As is generally recognized by those of skill in the art, "kicker" means an Ace, Two, Three or Four, as appropriate.

Version #2.

Version #2 of the present invention uses a standard fifty-two card deck of playing cards. This method of play is similar to that described in Version #1, but the player is playing multiple hands on the initial deal of the cards.

In this Version #2, a player makes an initial wager to activate the game and the player selects the number of hands that the player wishes to play during that round of the game. The player also determines the amount of the wager that is to be allocated to each hand of cards that the player will play.

For example, the player may make a wager of fifty credits and selects to play ten hands of cards. In the preferred embodiment of the present invention, the computer controls of the gaming machine will allocate five credits to each hand the player has selected to play. Alternatively, the computer controls could prompt the player to input the amount the player wishes to play on each hand.

After the wager is made and after the deck of playing cards has been electronically shuffled, a first hand of five cards is randomly dealt and displayed face up to the player on the screen display 20. Using another deck of standard playing cards that have been shuffled, a second hand of five cards is randomly dealt and displayed face up to the player on the screen display 20. This method of dealing continues until all ten hands of five cards are displayed to the player and represents the first level of play of the game.

Again, any suitable poker hand combinations can be designated was winning and losing hand combinations. The amount won by the player is determined according to a pay table based on the poker hand combination achieved by the player and the amount wagered by the player.

A representative pay table is shown in Table 2.

TABLE 2

| Poker Hand Combination | Payout Odds |
|---|---|
| Less than Pair of Sevens | Losing Hand |
| Pair of Sevens thru Aces | 1 for 1 |
| Two Pair | 3 for 1 |
| Three of a Kind | 5 for 1 |
| Straight | 7 for 1 |
| Flush | 9 for 1 |
| Full House | 18 for 1 |
| Four of a Kind (Fives through Kings) | 150 for 1 |
| Four of a Kind (Twos, Threes or Fours) | 250 for 1 |
| Four Aces | 400 for 1 |
| Four Twos, Threes or Fours with a Kicker | 500 for 1 |
| Four Aces with a Kicker | 800 for 1 |
| Straight Flush | 1000 for 1 |
| Royal Flush | 5000 for 1 |

As is generally recognized by those skilled in the art, "kicker" means an Ace, Two, Three or Four, as appropriate. Any suitable pay table can be used based on the percentage game return which the gaming establishment wishes to offer to the player.

Figure 3:
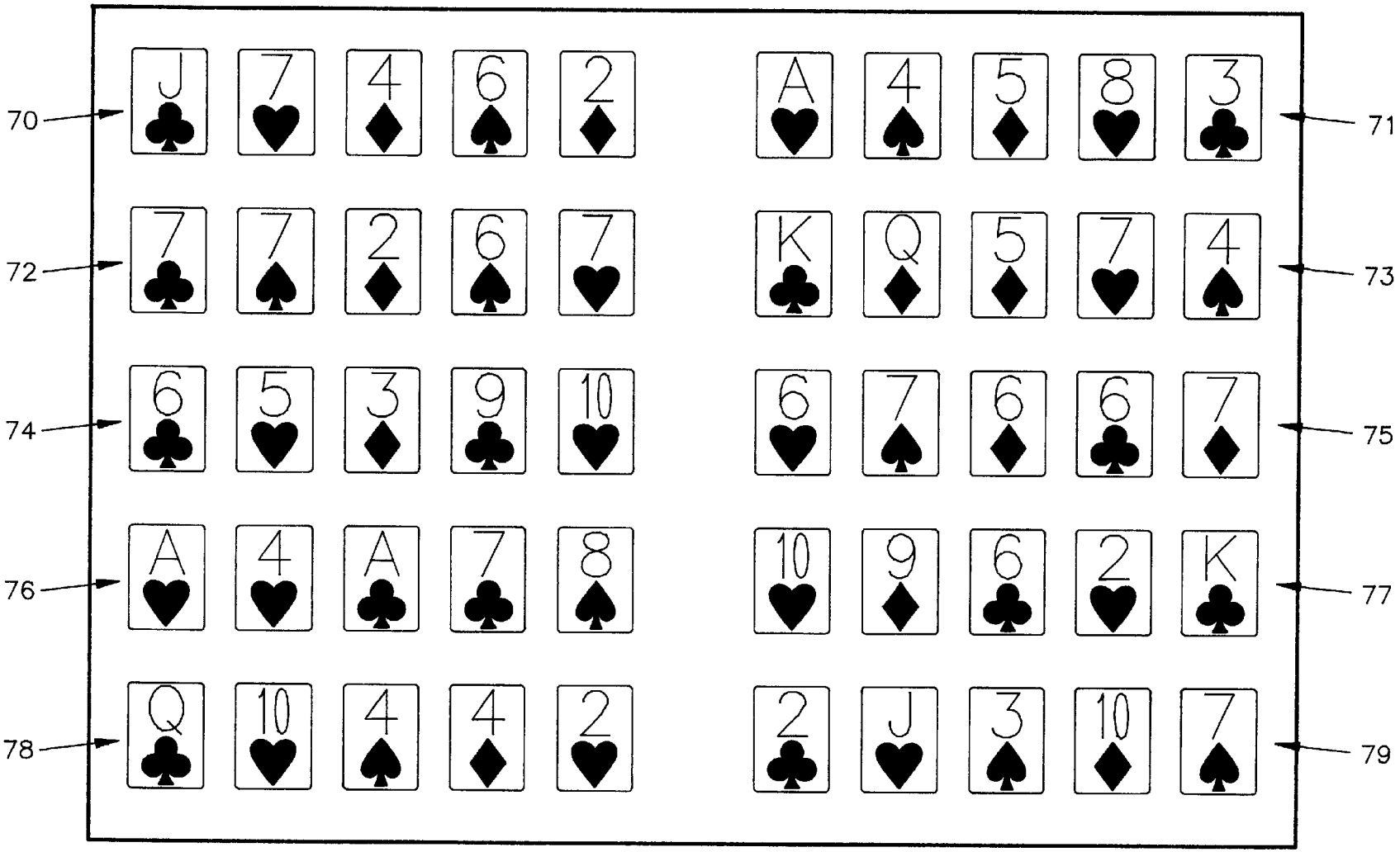
FIG. 3 shows the screen display for Version #2 of the present invention and shows a representative deal of a multiple number of stud poker hands that could occur during the play of the game.

FIG. 3 shows on the video screen display 20 the first five card stud hand 70, the second five card stud hand 71, the third five card stud hand 72, the fourth five card stud hand 73, the fifth five card stud hand 74, the sixth five card stud hand 75, the seventh five card stud hand 76, the eighth five card stud hand 77, the ninth five card stud hand 78 and the tenth five card stud hand 79.

FIG. 3 shows as a representative example of the ten five cards stud hands that could be dealt to a player. The first five card stud hand 70 has the Jack of Clubs, Seven of Hearts, Four of Diamonds, Six of Spades and Two of Diamonds. This would be a losing hand. The second five card stud hand 71 has an Ace of Hearts, Four of Spades, Five of Diamonds, Eight of Hearts and Three of Clubs. This would be a losing hand.

The third five card stud hand 72 has a Seven of Clubs, Seven of Spades, Two of Diamonds, Six of Spades and Seven of Hearts. This is a Three-of-a-Kind and would be a winning hand. The fourth five card stud hand 73 has a King of Clubs, Queen of Diamonds, Jack of Diamonds, Seven of Hearts and Four of Spades. This would be a losing hand.

The fifth five card stud hand 74 has a Six of Clubs, Five of Hearts, Three of Diamonds, Nine of Clubs and Ten of Hearts. This would be a losing hand. The sixth five card stud hand 75 has a Six of Hearts, Seven of Spades, Six of Diamonds, Six of Clubs and Seven of Diamonds. This is a Full House and would be a winning hand.

The seventh five card stud hand 76 has an Ace of Hearts, Four of Hearts, Ace of Clubs, Seven of Clubs and Eight of Spades. This is a Pair of Aces and would be a winning hand. The eighth five card stud hand 77 has a Ten of Hearts, Nine of Diamonds, Six of Clubs, Two of Hearts and King of Clubs. This would be a losing hand.

The ninth five card stud hand 78 has a Queen of Clubs, Ten of Hearts, Four of Spades, Four of Diamonds and Two of Hearts. This would be a losing hand. The tenth five card stud hand 79 has a Two of Clubs, Jack of Hearts, Three of Spades, Ten of Diamonds and Seven of Spades. This would be a losing hand.

The player has achieved three winning hands—Hand 72, Hand 75 and Hand 76. Using a representative pay table as shown in Table 2, the player would win five credits for each credit wagered for the Three-of-a-Kind of Hand 72, eighteen credits for each credit wagered for the Full House of Hand 75 and one credit for each credit wagered for the Pair of Aces of Hand 76.

Additionally, the player would receive another play of Hand 72, Hand 75 and Hand 76 for no additional wager since each of these hands was a winning hand.

Figure 4:
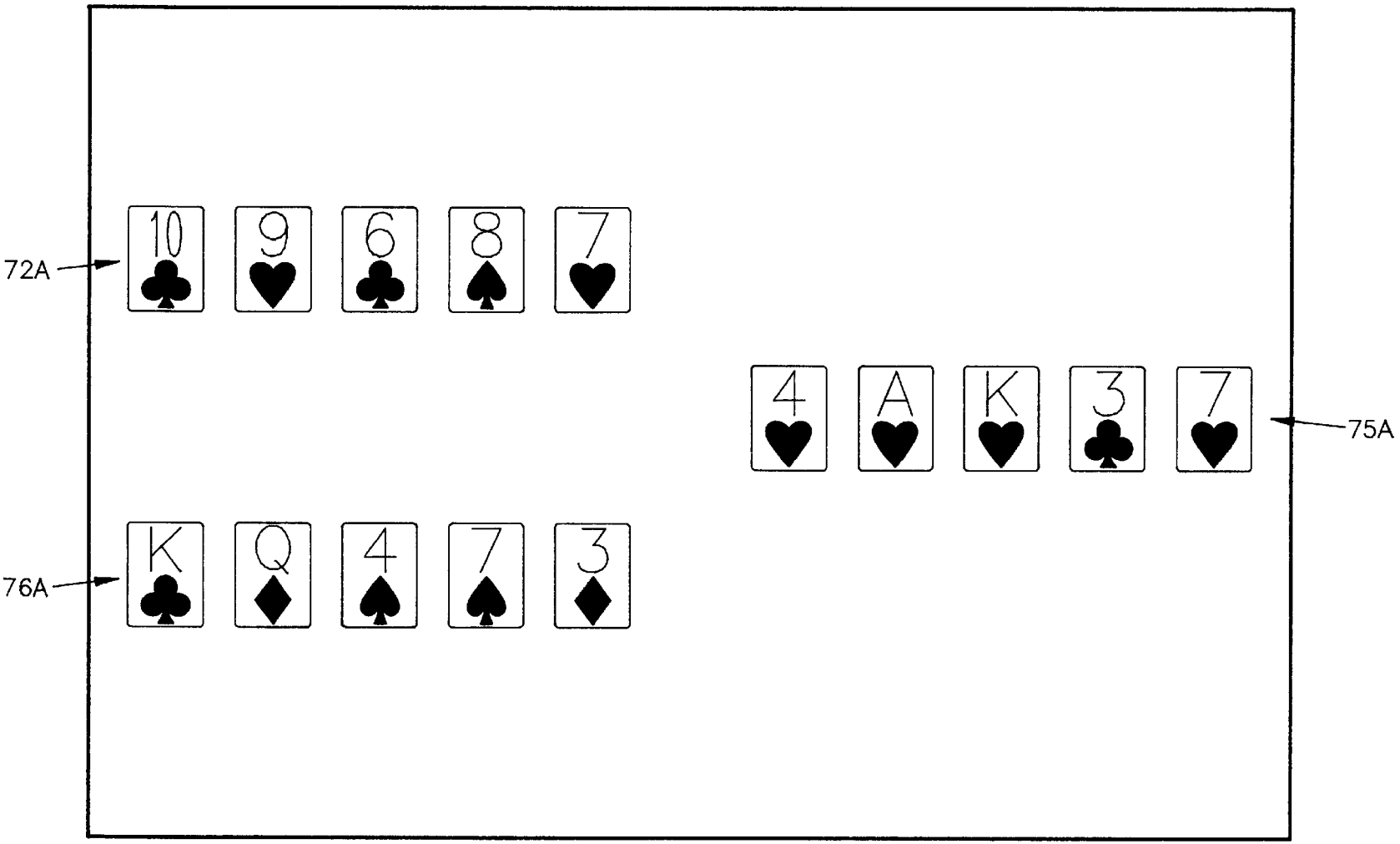
FIG. 4 shows the screen display for Version #2 of the present invention and shows a representative redial of stud poker hands that could occur during the play of the game.

FIG. 4 shows a representative deal of the additional hands 72A, 75A and 76A and represents the second level of play of the game. In Hand 72A, the player has a Ten of Clubs, Nine of Hearts, Six of Clubs, Eight of Spades and Seven of Hearts. This is a Straight and would be a winning hand.

In Hand 75A, the player has an Four of Hearts, Ace of Hearts, King of Hearts, Three of Clubs and Seven of Hearts. This would be a losing hand. In Hand 76A, the player has a King of Clubs, Queen of Diamonds, Four of Spades, Seven of Spades and Three of Diamonds. This would be a losing hand.

Using the representative pay table as shown in Table 2, the player would win seven credits for each credit wagered for the Straight of Hand 72A. Additionally, the player would receive another play of Hand 72A for no additional wager since this hand was a winning hand.

Figure 5:
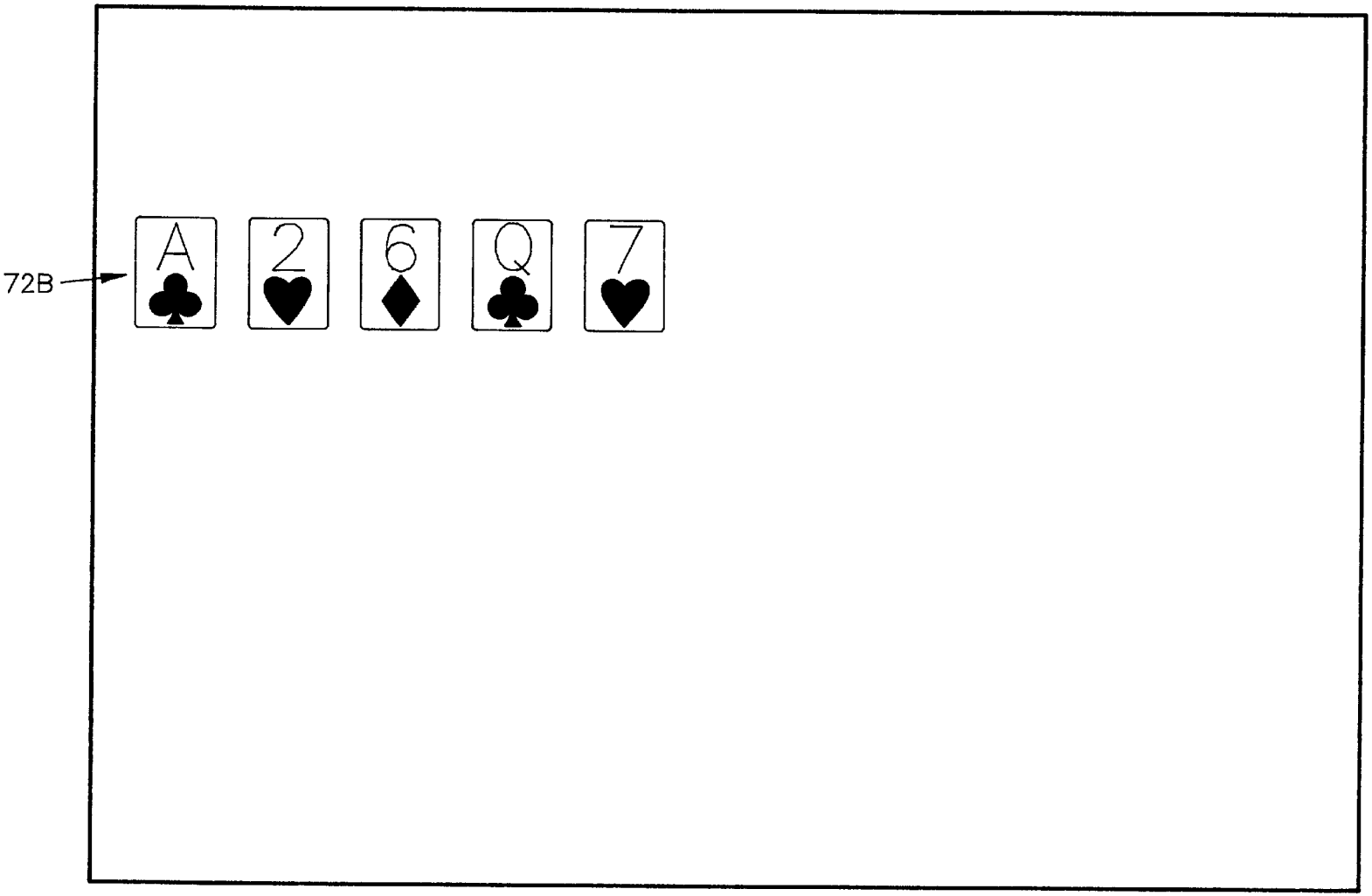
FIG. 5 shows the screen display for Version #2 of the present invention and shows another representative redial of a stud poker hand that could occur during the play of the game.

FIG. 5 shows a representative deal of the additional hand 72B which represents the third level of play of the game. In Hand 72B, the player has an Ace of Clubs, Two of Hearts, Six of Diamonds, Queen of Clubs and Seven of Hearts. This would be a losing hand. Because the player has now achieved losing hands on all of the ten hand locations that the player initially wagered on, the round of the game would be over and the player would have to make a new wager in order to continue playing the game.

A bonus feature may be added to the method of play of the present invention. The player may be awarded additional bonus amounts for achieving a high number of levels of play before the player has all losing hands. In the example shown in FIGS. 3–5, the player has achieved three levels of play before the player has all losing hands. The player could be awarded bonus pay out amounts depending on how many levels the player achieved before the round of the game ended. These bonus amounts could be fixed amounts or progressive pay out amounts.

Alternatively, the player may be awarded additional bonus amounts for achieving a high number of hands played before the player has all losing hands. These bonus pay out amounts could be fixed amounts or progressive pay out amounts. With regard to the example shown in FIGS. 3–5, the player had a total of four winning hands before the round ended and the player could be awarded a bonus pay out depending on how many winning hands the player achieved before the round of the game ended.

These bonus awards can be calculated mathematically based on the probability of the player achieving a number of levels of play before all the hands become losing hands or based on the probability of the player achieving a number of winning hands before all the hands become losing hands. Using the calculated probabilities, the amounts of the bonus awards can be selected and integrated with the pay outs for the winning stud poker hand combinations to determine the desired overall game return.

Another variation can use stud hands having more than five cards—such as six card, seven card or more card stud hands. Winning hand combinations can be based on the best five card poker hand achieved out of the six, seven or more card hands. Alternatively, the winning hand combinations can be the best six, seven or more card stud poker hand achieved. When six or more card poker hands are used, then additional non-traditional poker hand rankings can be used as winning card combinations such as two Three-of-a-Kinds, or a Four-of-a-Kind and a Pair, Six (or more) Card Straight Flushes and Six (or more) Card Royal Flushes. The pay tables would be modified to account for the mathematical probabilities of achieving these different poker hand rankings.

Another variation would include designating certain cards as wild cards or adding one or more Jokers to the standard deck and using the Jokers as wild cards. When wild cards are used, the pay tables would need to be recalculated to reflect the change in the probability of the various winning hand combinations as well as any other desired card combinations (such as Five-of-a-Kinds or Wild Royal Flushes) that could be used as winning combinations.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a stud poker card game comprising:

a) a player making a wager to play the stud poker game;

b) dealing a first five card stud poker hand to the player;

c) determining the poker hand ranking of the first stud poker hand;

d) if the first stud poker hand is a winning combination, awarding the player a pre-established amount based on the amount of the wager;

e) dealing a second five card stud poker hand to the player for no additional wager, and f) determining the poker hand ranking of the second stud poker hand and if the second stud poker hand is a winning combination, awarding the player a pre-established amount based on the amount of the wager.

2. The method of claim 1 further including the steps of:

a) if the second stud poker hand is a winning combination, dealing a third five card stud poker hand to the player for no additional wager; and b) determining the poker hand ranking of the third stud poker hand and if the third stud poker hand is a winning combination, awarding the player a pre-established amount based on the amount of the wager.

3. A method of playing a stud poker card game comprising:

a) a player making a wager to play the stud poker game;

b) dealing a first stud poker hand to the player;

c) determining the poker hand ranking of the first stud poker hand;

d) if the first stud poker hand is a winning combination, awarding the player a pre-established amount based on the amount of the wager;

e) dealing a second stud poker hand to the player for no additional wager, and f) determining the poker hand ranking of the second stud poker hand and if the second stud poker hand is a winning combination, awarding the player a pre-established amount based on the amount of the wager.

4. The method of claim 3 further including the steps of:

a) if the second stud poker hand is a winning combination, dealing a third stud poker hand to the player for no additional wager; and b) determining the poker hand ranking of the third stud poker hand and if the third stud poker hand is a winning combination, awarding the player a pre-established amount based on the amount of the wager.

5. A method of playing a stud poker card game comprising:

a) a player making a wager to play the stud poker game;

b) dealing a plurality of five card stud poker hands to the player;

c) determining the poker hand ranking of each stud poker hand;

d) awarding the player a pre-established amount based on the amount of the wager for each stud poker hand that is a winning combination; and e) dealing additional five card stud poker hands to the player for no additional wager for each stud poker hand that is a winning combination.

6. The method of claim 5 further including the steps of:

a) determining the poker hand ranking of each of the additional stud poker hands;

b) awarding the player a pre-established amount based on the amount of the wager for each additional stud poker hand that is a winning combination;

c) dealing still additional five card stud poker hands to the player for no additional wager for each stud poker hand that is a winning combination; and d) repeating steps a), b) and c) for any subsequent hands until the player achieves all stud poker hands being a losing combination.

7. The method of claim 6 including the step of awarding the player a bonus amount based on a number of levels achieved by the player until all of the stud poker hands are losing combinations.

8. The method of claim 6 including the step of awarding the player a bonus amount based on a number of winning stud poker hands achieved by the player until all of the stud poker hands are losing combinations.

9. A method of playing a stud poker card game comprising:

a) a player making a wager to play the stud poker game;

b) dealing a plurality of stud poker hands to the player;

c) determining the poker hand ranking of each stud poker hand;

d) awarding the player a pre-established amount based on the amount of the wager for each stud poker hand that is a winning combination; and e) dealing additional stud poker hands to the player for no additional wager for each stud poker hand that is a winning combination.

10. The method of claim 9 further including the steps of:

a) determining the poker hand ranking of each of the additional stud poker hands;

b) awarding the player a pre-established amount based on the amount of the wager for each additional stud poker hand that is a winning combination;

c) dealing still additional stud poker hands to the player for no additional wager for each stud poker hand that is a winning combination; and d) repeating steps a), b) and c) for any subsequent hands until the player achieves all stud poker hands being a losing combination.

11. The method of claim 10 including the step of awarding the player a bonus amount based on a number of levels achieved by the player until all of the stud poker hands are losing combinations.

12. The method of claim 10 including the step of awarding the player a bonus amount based on a number of winning stud poker hands achieved by the player until all of the stud poker hands are losing combinations.

13. A method of playing a stud poker card game comprising:

a) a player making a wager to play the stud poker game;

b) dealing a first five card stud poker hand to the player;

c) determining the poker hand ranking of the first stud poker hand;

d) if the first stud poker hand is a winning combination, awarding the player a pre-established amount based on the amount of the wager;

e) dealing a second five card stud poker hand to the player for no additional wager;

f) determining the poker hand ranking of the second stud poker hand and if the second stud poker hand is a winning combination, awarding the player a pre-established amount based on the amount of the wager and awarding the player a third stud poker hand; and g) repeating steps d), e) and f) for the third and any subsequent hands until the player achieves a hand having a losing combination.

14. A method of playing a stud poker card game comprising:

a) a player making a wager to play the stud poker game;

b) dealing a first stud poker hand to the player;

c) determining the poker hand ranking of the first stud poker hand;

d) if the first stud poker hand is a winning combination, awarding the player a pre-established amount based on the amount of the wager;

e) dealing a second stud poker hand to the player for no additional wager;

f) determining the poker hand ranking of the second stud poker hand and if the second stud poker hand is a winning combination, awarding the player a pre-established amount based on the amount of the wager and awarding the player a third stud poker hand; and g) repeating steps d), e) and f) for the third and any subsequent hands until the player achieves a hand having a losing combination.

* * * * *